US009306290B1

(12) United States Patent
Grop

(10) Patent No.: US 9,306,290 B1
(45) Date of Patent: Apr. 5, 2016

(54) CONTROLLER BARRIER LAYER AGAINST ELECTROMAGNETIC RADIATION

(75) Inventor: Anders Grop, Hässelby (SE)

(73) Assignee: FOERSVARETS MATERIELVERK, STOCKHOLM (SE)

( * ) Notice: Subject to any disclaimer, the term of this patent is extended or adjusted under 35 U.S.C. 154(b) by 2092 days.

(21) Appl. No.: 10/584,561

(22) Filed: May 31, 2007

(51) Int. Cl.

| | |
|---|---|
| ***H01Q 17/00*** | (2006.01) |
| ***H01Q 15/22*** | (2006.01) |
| ***H01Q 1/42*** | (2006.01) |
| ***H01Q 15/00*** | (2006.01) |

(52) U.S. Cl.
CPC ..... *H01Q 17/00* (2013.01); *H01Q 15/0013* (2013.01); *H01Q 15/22* (2013.01); *H01Q 17/007* (2013.01); *H01Q 17/008* (2013.01); *H01Q 1/42* (2013.01); *H01Q 1/422* (2013.01)

(58) Field of Classification Search
CPC ... G01S 13/95; G01S 13/532; G01S 13/5244; G01S 13/951; G01S 13/227; H01Q 15/00; H01Q 15/0006; H01Q 15/0013; H01Q 15/12; H01Q 15/22; H01Q 15/23; H01Q 15/24
USPC ..... 342/1–6, 188; 343/909
See application file for complete search history.

(56) References Cited

U.S. PATENT DOCUMENTS 5,298,903 A * 3/1994 Janos ..... H01Q 17/00 342/4
5,959,594 A * 9/1999 Wu ..... H01Q 15/02 343/753
6,396,451 B1 * 5/2002 Wu ..... H01Q 15/24 343/756
2004/0206527 A1 * 10/2004 Yokota ..... H05K 9/0003 174/377
2007/0222658 A1 * 9/2007 Puscasu ..... H01Q 15/0013 342/1

FOREIGN PATENT DOCUMENTS

BE EP 0798574 A2 * 10/1997 ..... G02B 5/1809
CA EP 0434374 A2 * 6/1991 ..... H01Q 1/248

OTHER PUBLICATIONS

Lynch, J.J.; Colburn, J.S., "Modeling polarization mode coupling in frequency-selective surfaces," in Microwave Theory and Techniques, IEEE Transactions on , vol. 52, No. 4, pp. 1328-1338, Apr. 2004.*

* cited by examiner

*Primary Examiner* — John B Sotomayor
(74) *Attorney, Agent, or Firm* — Jacobson Holman, PLLC.

(57) ABSTRACT

The present invention relates to a controllable barrier layer against electromagnetic radiation, to be used, inter alia, as a radome for a radar antenna for instance. The barrier layer comprises a first frequency selective layer (4) of a given geometric shape, said frequency selective layer transmitting radiation of a certain polarization within a desired frequency band and reflecting radiation of a different polarization and radiation outside said band and at least a second identical frequency selective layer, which is placed close to or in connection with the first layer in the radiation direction. The layers are configured to be placed in a first position relative to each other so that they together obtain transmission properties similar to those of the first layer alone and in a second position relative to each other so that they together reflect radiation of said certain polarization within said desired frequency band.

4 Claims, 2 Drawing Sheets

CONTROLLER BARRIER LAYER AGAINST ELECTROMAGNETIC RADIATION

Figure 1:
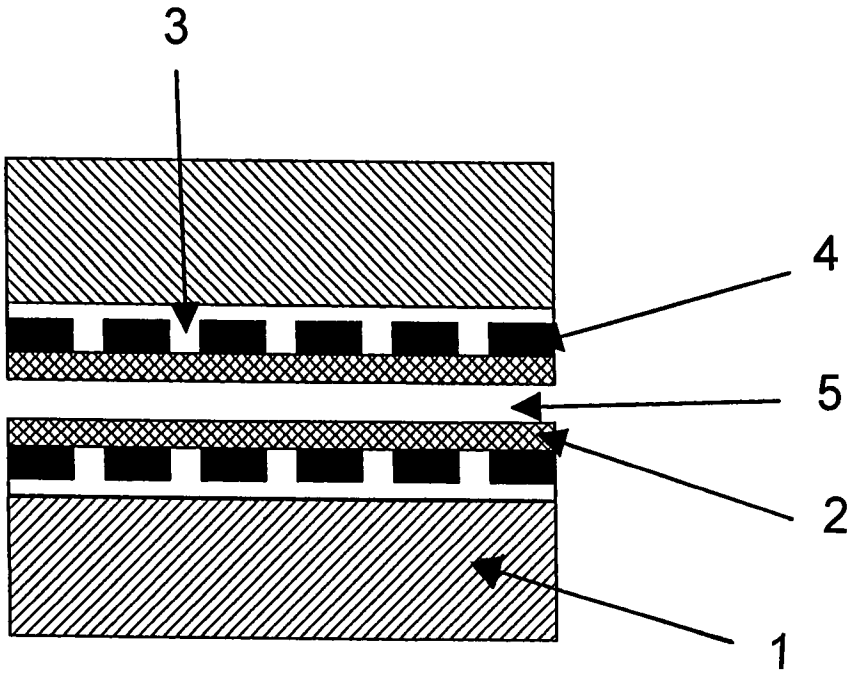

The present invention relates to a controllable barrier layer against electromagnetic radiation, to be used, inter alia, as a radome for a radar antenna for instance.

Radomes are normally used to afford physical and environmental protection to equipment, such as microwave antennas. At the same time it is advantageous to shield such equipment from incident electromagnetic radiation that can have a negative effect on its function and, in addition, frequently produces strong reflections in the equipment, which results in a higher radar cross section.

A well-known technique of shielding radiation outside the working frequencies of an antenna is to provide the radome with what is called an FSS layer (Frequency Selective Surface). An FSS radome normally comprises one or more electromagnetically transparent materials, optionally with different dielectric constants. Moreover there are usually one or more electrically conductive layers which are patterned and have low-pass, high-pass or band-pass filter characteristics and reflect incident radiation outside the working range of the radar. The reflection and transmission properties are controlled, inter alia, by the design of the patterns. The patterns can be etched from a thin copper layer which is applied to a dielectric material.

The conductive layer or layers are transparent to radiation of a certain polarisation at the working frequencies of the antenna, but reflective to radiation of a different polarisation (and, as stated above, to radiation outside this frequency band). The change between transmission and reflection does, of course, not occur by jumps, whether with respect to frequency or with respect to polarisation, but occurs gradually. The FSS technique is well-known to those skilled in the art. A less experienced person can study this technique in, for example, the book "Frequency selective surfaces, Theory and design" by Ben A. Munk, ISBN 0-471-37047-9, which is hereby incorporated by reference.

In the band of working frequencies of an antenna, where an FSS radome transmits incident radiation, the antenna often produces strong reflections, which is not desirable from the view-point of radar cross section. It would be better if all incident radiation be reflected in a controlled manner in the radome, at least when the radar to be protected does not transmit or receive radiation.

Experiments have been made to control a radome surface in different ways so that it transmits radiation in the band of the working frequencies of the antenna only when the antenna operates and in between reflects radiation also in this band. U.S. Pat. No. 4,684,954 discusses such a proposal which is based on electrical change-overs in components in the radome layer. Different prior art radome solutions all suffer from different drawbacks.

The present invention provides a new solution to the current problem, which eliminates many of the previous drawbacks. The invention achieves its object by being configured in the way that is defined by the independent claim. The remaining claims concern advantageous embodiments of the invention.

Figure 2:
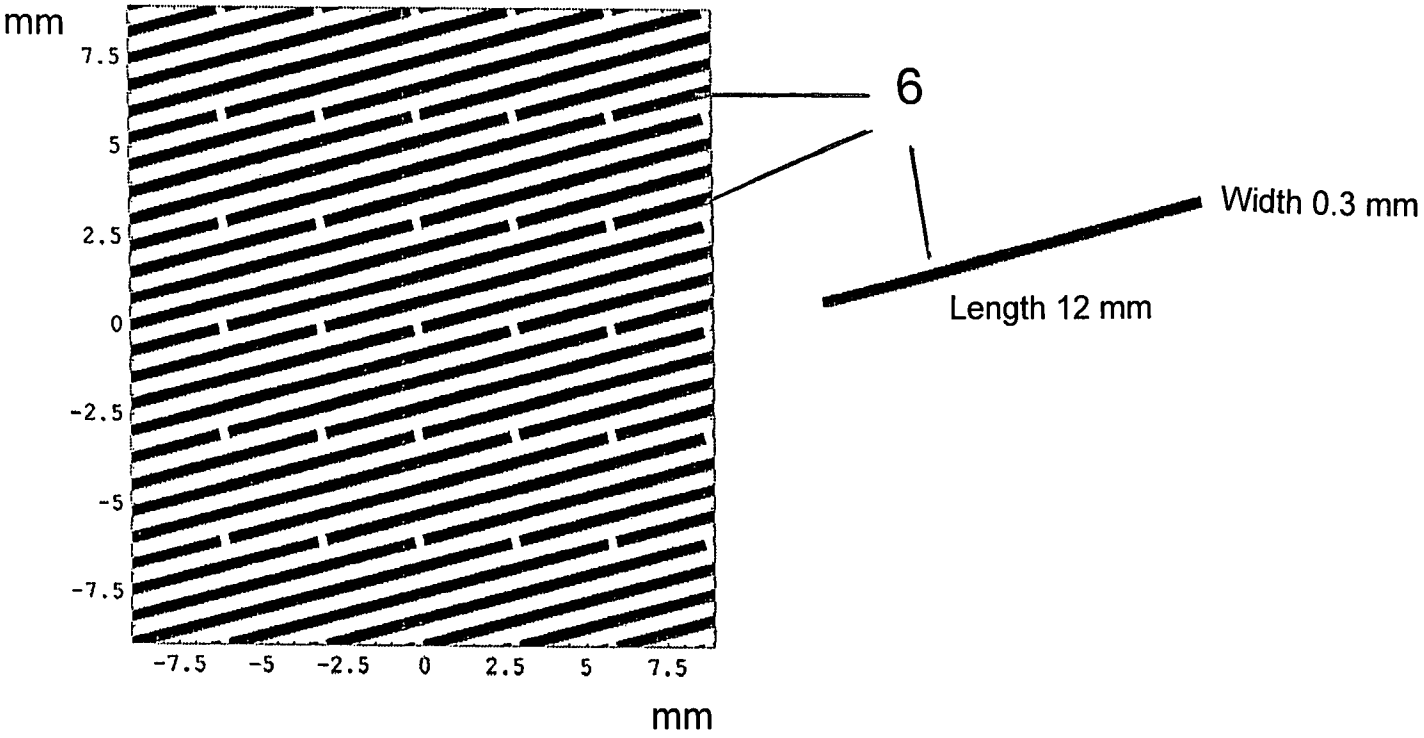

The invention will in the following be described in more detail with reference to the accompanying drawings, in which FIG. 1 is a cross-section of an embodiment of a controllable radiation barrier layer according to the invention, and FIG. 2 illustrates an example of a prior art FSS layer which can be used in the invention.

The present invention operates with at least two FSS layers and a purely mechanical shutter function. The basic idea is to provide a radiation barrier layer by using two, or more, FSS layers in the radiation direction and purely mechanically move them relative to each other. In a first position, with the layers adapted to each other, they obtain together transmission properties similar to those of one layer alone, which means that they transmit radiation of a certain polarisation around the working frequencies of the antenna or corresponding equipment. In a second position, the patterns of the FSS layers are adapted to reflect all radiation. Of course, the transmission and the reflection are changed gradually when changing from the first position to the second position.

With flat layers, the movement can occur by translation in the plane of the layers or rotation about the normal of the layers, or a combination thereof. Also if the layers are curved rotationally symmetrical layers, rotation can occur about the axis of rotation of the layers. If the layers are one-dimensionally curved, the movement can occur by a translation in the plane of the layers perpendicular to the plane of curvature.

If the barrier layer is more or less flat, it can for other reasons, for instance aerodynamic considerations, be placed inside an ordinary generally transmitting radome.

In a studied example, the barrier layer was flat and dimensioned to be transparent, in the first position, around the centre frequency 10 GHz for vertically polarised radiation. The antenna behind was intended to illuminate the barrier layer with normal incidence and vertical polarisation. The barrier layer was assumed to be exposed to hostile illumination at the elevation angle 1° relative to the normal of the barrier layer. The threat band was assumed to be 2-20 GHz. The barrier layer would in the closed position be reflective to all polarisations of the incident signal. In the open position, the barrier layer would be reflective to cross polarisation relative to the polarisation of the sensor, that is to horizontal polarisation.

These assumptions result in a composition of the barrier layer as shown in FIG. 1. The barrier layer was configured as two flat polarisation layers which could be rotated relative to each other and which were of what is referred to as half-wave design, that is had a total thickness of the barrier layer/radome wall corresponding to half a wavelength at the frequency to which it is adjusted. Such a layer should be about 7 mm thick at 10 GHz. In the current case, the barrier layer consisted of two glass composite layers 1 of 2.8 mm each with FSS carriers 2 with glue 3 adhered to the opposing surfaces of the glass fibre composite layers. The FSS layers 4 were made of copper and mounted on the respective glass fibre composite layers 1 so that their carriers 2 protected them from being damaged during rotation. The thickness of the FSS layers with carriers was 0.35 mm. The intermediate air gap 5 was kept as thin as possible.

In the example studied, an FSS pattern in the form of linear dipoles was selected. Such a layer is reflective to signals which are polarised parallel to the dipoles and transparent to signals which are polarised perpendicular to the dipoles. To ensure a great bandwidth, the dipoles were packed extremely densely in a grid of the type Gangbuster type 4, see FIG. 2. In the example, the dipoles 6 were 12 mm long and had a width of 0.3 mm. The periodicity was about 3 mm.

Calculations showed that the desired barrier effect was achieved. As soon as the layers were rotated from the first position with parallel dipoles in the two layers, the transmission through the layers decreased and at ±90°+n. 180° the combined barrier layer reflected at a maximum. Depending on the flatness or curvature of the barrier layer and the design of the hole pattern, the desired barrier effect can in other examples be obtained for other angles of rotation.

Since two or more parts are to be moved relative to each other, the thus arising interface or interfaces must be taken into special consideration. If two parts are allowed to mechanically contact each other, it must be ensured that the FSS layer is mechanically protected. In addition, the FSS layers are for electrical reasons not allowed to contact each other.

Of course, it is possible to have air in the gap between the two parts, but in some applications, a liquid would be better. The liquid should have a dielectric constant which is adjusted to the dielectric constant in the neighbouring materials.

It is important that no dimensional changes occur in the two parts and the gap since such changes might cause transmission losses/distortions, both when the antenna to be protected transmits through the barrier layer/radome and when the barrier layer is reflective to all radiation. The most important thing is to keep the correct distance (minimum dimensional change) between the parts in the transmission or reception. It is then necessary to ensure that the layers are not bent when the radome is subjected to external loads.

If air, or some other gas, or liquid is used between the layers, it is possible to minimise the gap and, thus, create stability to the barrier layer by extracting gas or liquid from the gap by negative pressure. To prevent wear, the gap can then be slightly increased before moving the two layers relative to each other.

By letting liquid or gas circulate through the gap, it is possible to produce active cooling in order to reduce and control the temperature of the barrier layer, which reduces and controls the thermal signature. Controlling can take place by changes in the temperature of the flowing medium or the flow rate, or both. In this case, gaps should be positioned close to the FSS layers since this is where most of the heat is generated.

The invention claimed is:

1. A controllable barrier layer against electromagnetic radiation, comprising a first frequency selective layer (4) of a given geometric shape, said frequency selective layer transmitting radiation of a certain polarisation within a desired frequency band and reflecting radiation of a different polarisation and radiation outside said band, characterised in that it comprises at least a second identical frequency selective layer, of said given geometric shape, which is placed closed to or in connection with the first layer in the direction of the radiation, that the layers are configured to be placed in a first position relative to each other so that they together obtain transmission properties similar to those of the first layer alone, and that the layers are configured to be placed in a second position relative to each other so that they together reflect radiation of said certain polarisation within said desired frequency band.

2. A controllable barrier layer as claimed in claim 1, characterised in that the frequency selective layers are surfaces of rotation, or in a special case flat, and the relative movement between the first position and the second position occurs by rotation of one of, or both, the layers about the symmetry axis of the surfaces of rotation or, in the flat case, the normal of the layers.

3. A controllable barrier layer as claimed in claim 1, characterised in that the frequency selective layers are one-dimensionally curved, or in a special case flat, and the relative movement between the first position and the second position occurs by translation of one of, or both, the layers in the plane of the layers, in the curved case perpendicular to the plane of curvature.

4. A controllable barrier layer as claimed in claim 1, characterised in that a gas or a liquid is passed between said first frequency selective layer and said at least second frequency selective layer, and that the thermal signature of the barrier layer is controlled by temperature changes in the gas or the liquid and/or changes in their flow rate.

* * * * *